US005479232A

United States Patent [19]

Van den Bergen et al.

[11] Patent Number: 5,479,232

[45] Date of Patent: Dec. 26, 1995

[54] PHOTOGRAPHIC PROCESSING STATION WITH CLEANING ROLLERS

[75] Inventors: Patrick Van den Bergen, Berchem; Luc De Roeck, Kontich; Rony Van Bouwel, Ranst, all of Belgium

[73] Assignee: Agfa-Gevaert N.V., Mortsel, Belgium

[21] Appl. No.: 316,241

[22] Filed: Sep. 30, 1994

[30] Foreign Application Priority Data

Oct. 11, 1993 [EP] European Pat. Off. ..... 93202862

[51] Int. Cl.[6] ..... G03D 3/08

[52] U.S. Cl. ..... 354/320; 354/324

[58] Field of Search ..... 354/316–325; 134/64 P, 64 R, 122 P, 122 R; 118/637

[56] References Cited

U.S. PATENT DOCUMENTS

| | | | |
|---|---|---|---|
| 3,874,394 | 4/1975 | Robertson | 134/6 |
| 3,955,533 | 5/1976 | Smith et al. | 118/637 |
| 4,091,404 | 5/1978 | Schörnig et al. | 354/321 |
| 4,745,423 | 5/1988 | Uchida | 354/320 |

FOREIGN PATENT DOCUMENTS

| | | | |
|---|---|---|---|
| 3-241348 | 10/1991 | Japan | 354/323 |

*Primary Examiner*—D. Rutledge

*Attorney, Agent, or Firm*—Brumbaugh, Graves, Donohue & Raymond

[57] ABSTRACT

A photographic processor for treating an image-wise exposed photographic sheet material with a processing liquid, which comprises:

developing (12), a fixing (13) and a rinsing (14) station, driven pressure roller pairs (21, 22, 23, 24, 25) in the rinsing station for conveying sheet material through a body of rinsing water in said station, the lower rollers of the roller pairs dipping completely in the liquid and the upper rollers dipping only partially therein, and cleaning rollers (26, 27, 29) with a circumferential covering of a pile fabric, which are in frictional contact with the upper rollers of said roller pairs, and the peripheral speed of which is equal to that of the corresponding upper roller(s).

16 Claims, 2 Drawing Sheets

PHOTOGRAPHIC PROCESSING STATION WITH CLEANING ROLLERS

DESCRIPTION

1. Field of the Invention

The present invention relates to a photographic processor with a rinsing station, more in particular with a washing/rinsing station for wash-off colour proofing material.

2. Description of the Prior Art

Colour proofs are required for inspection and approval by the printer or his client before printing on the production press commences.

According to a common colour proofing process, a non-hardened gelatin silver halide emulsion layer containing coloured pigment particles dispersed therein is transferred from a temporary onto a permanent support which may already carry a halftone image containing coloured hardened gelatin, the transferred silver halide emulsion layer is image-wise exposed to a colour separation negative of the original, a halftone image is formed by hardening development, the formed silver image is removed by bleach-fixing, the selectively unhardened portions of the transferred layer are selectively removed by wash-off processing, and all these steps are repeated to form a composite layer structure containing usually a cyan, a yellow, a magenta and a black-and-white part image. The term wash-off processing implies treating the permanent support with water to remove the unhardened portions thereof, resulting in the accumulation of gelatin and pigments in the rinsing water, but also rinsing the washed support in order to eliminate the very last unhardened components that otherwise may cause an undesirable hue in the final image.

Treating the described support usually occurs by means of one or more rinsing tanks through which the support is conveyed by means of a plurality of pressure roller pairs dipping at least partly in the rinsing liquid. At least the roller of each roller pair which is in contact with the image-side of the support has a resilient covering, which is partly compressed by the bias of the opposite roller of the accelerated and decelerated during its rotation on the opposite roller, or on the support conveyed between the two rollers. The mentioned acceleration and deceleration of the resilient roller covering causes important frictional forces in the image layer which cause the unhardened portions of the transferred layer to become washed off. The washed-off material becomes dispersed in the rinsing tank(s) and does not destroy the satisfactory washing-off of further supports, unless the loading of the rinsing water exceeds a certain level. Replenishing of the rinsing tank(s) with fresh water at regular intervals in response to the amount of processed material keeps the composition of the rinsing water at an operational level.

All the roller pairs of a rinsing tank are not completely immersed in the rinsing liquid. This is particular the case for the inlet and exit roller pairs that necessarily are at a higher level than the other ones because of the concave path followed by a sheet through a tank. However, it may occur that all the roller pairs have their lower rollers only immersed completely in the processing liquid whereas their upper rollers only partly dip in the liquid. This is done in some cases in compact installations in which the shafts of the upper rollers extend beyond a lateral wall of the tank for entering in driving engagement with a drive shaft. In such case, the level of the liquid must be well below the shafts of such upper rollers, unless expensive liquid-sealed bearings are used.

We have found that washing and rinsing rollers may cause defects in the form of bands on processed supports. The mentioned defect has been noted in particular if a certain sheet format is being processed for a certain period, and then a wider sheet format is processed in the apparatus. It was shown that the portions of the wider sheet extending beyond the size of the former smaller sheets showed a linewise defect caused by deposits left on the upper rollers of the roller pairs at locations beside those contacted by the smaller sheets. The extent of these deposits is very small and therefore they are not visible on a series of processed sheets of equal formats. However, as a larger sheet is processed after a number of smaller sheets, there are marks on such larger sheet in the transport direction. As more such larger sheets are processed, the marks gradually disappear.

The mentioned defect was not noted with prior art apparatus because the rate of replenishing was so high that pollution of the rinsing water by washed-off gelatin and pigments did not form a problem. However present-day environmental requirements ask for ever reduced amounts of rinsing water, and in these circumstances the loading of the rinsing water with matter removed from processed sheets becomes high whereby the described defect is caused.

SUMMARY OF THE INVENTION

Object of the invention

It is an object of the present invention to provide an improved photographic processor with a rinsing station in which soiling of a processed sheet by deposits accumulating on at least the upper rollers of pressure roller pairs that transport a sheet through such station is avoided.

The invention is in particular intended for use with rinsing station in which the rate of replenishing of rinsing water is small.

The present invention has been particularly developed in connection with colour proofing as described hereinbefore and therefore the detailed description of the invention relates in particular to this application.

Statement of the invention

In accordance with the present invention a photographic processor for treating an image-wise exposed photographic sheet material with a processing liquid, comprises a rinsing station for containing a body of rinsing water, replenishing means for adding fresh rinsing water to said station, driven pressure roller pairs for conveying said sheet material through said body of rinsing water, and at least one cleaning roller with a circumferential covering of a pile fabric, which is in frictional contact with one roller of said roller pair of said pressure roller pairs, and the peripheral speed of which is equal to that of said one roller.

The term "replenishing" stands in the present specification for the operation of replacing a certain amount of used rinsing water by fresh water in order to maintain desired rinsing conditions, and/or adding liquid in order to compensate for liquid which is carried off by a processed sheet.

According to a suitable embodiment of the invention, the lower rollers of the pressure roller pairs completely dip in the rinsing liquid whereas the upper rollers only partially dip therein, and the cleaning roller(s) is (are) in contact with such upper rollers of the roller pairs.

In operation of the processor according to the invention, it has been shown that the cleaning rollers are operative to remove deposits from the upper rollers of the different pressure roller pairs that could give rise to easily visible bands and streak-like defects on the processed sheets. This does not mean that the cleaning rollers completely clean said rollers. It is believed that a first effect of the cleaning rollers is an equalization of deposits on the rollers of the pressure roller pairs, in particular in the axial direction of said rollers so that the appearance of streak-like defects is avoided. A second effect of said cleaning rollers is a partial removal of deposits from the rollers of the roller pairs.

A third effect is the spontaneous equilibration of the amount of deposits on the surface of the cleaning rollers. This means that rinsing liquid which is applied to the cleaning rollers by rotating contact with a corresponding roller of a pressure roller pair continously removes deposits from such cleaning roller to a certain extent so that the concentration of deposits on the cleaning rollers remains limited. This has the advantage that the cleaning rollers are self-cleaning to an extent such that the normal operation of the processor need not be interrupted for periodic cleaning of such rollers.

According to a suitable embodiment of the invention which allows a very simple construction of a rinsing station, the cleaning rollers are driven by frictional contact with the corresponding pressure rollers. Further, the cleaning rollers can be located between successive roller pairs so that they are in frictional contact with two rollers of two adjacent pressure roller pairs whereby the number of cleaning rollers can be smaller than the number of pressure roller pairs.

According to a further suitable embodiment of the invention, the cleaning rollers are arranged for performing an axial displacement during their rotation and such axial movement may result from the rotation of said rollers. For instance, the shafts of the cleaning rollers may be provided with a follower co-operating with a stationary cam, and said cam and follower may be kept in engagement with each other by spring means which axially biases said cleaning rollers.

The cleaning rollers of a processor according to the present invention should not be confused with processing rollers known in the art that are used for removing excess of rinsing or processing liquid from a pressure roller pair used for transporting a sheet through a processor.

Referring to EP 563 989 A1, a processor is disclosed which comprises spray pipes located at the wash-over of the distinct processing stations for ejecting diluting water (washing water) towards the exit pair of pressure rollers of each station. Excess of diluting water is removed from said pressure rollers by squeezing rollers and flows in the processing liquid of the station thereby reducing its concentration and consequently altering the processing conditions. This processor requires appropriate control since washing water must be sprayed on the conveying rolles only when film is not being conveyed by such conveying rollers. In the processor according to the present invention on the contrary there is no control whatsoever: the cleaning rollers simply ride on the upper roller of a pressure roller pair, and there is no extra supply washing water towards the cleaning roller or the co-operating pressure roller pair. Furthermore, no liquid is squeezed from a pressure roller by contact with a cleaning roller.

Referring to GB 1 393 566, a film processor is disclosed which comprises squeezing roller pairs on roller of such pairs having a resilient fibreous covering which is depressed along its line of contact with its companion roller. The described arrangement requires exposure of the resilient roller to a bath of fresh solution which washes the reacted chemicals from the covering of the roller. This exposure seriously complicates the construction and operation of the apparatus.

BRIEF DESCRIPTION OF THE DRAWINGS

The invention will be described hereinafter by way of example with reference to the accompanying drawings wherein.

DETAILED DESCRIPTION OF THE INVENTION

Figure 1:
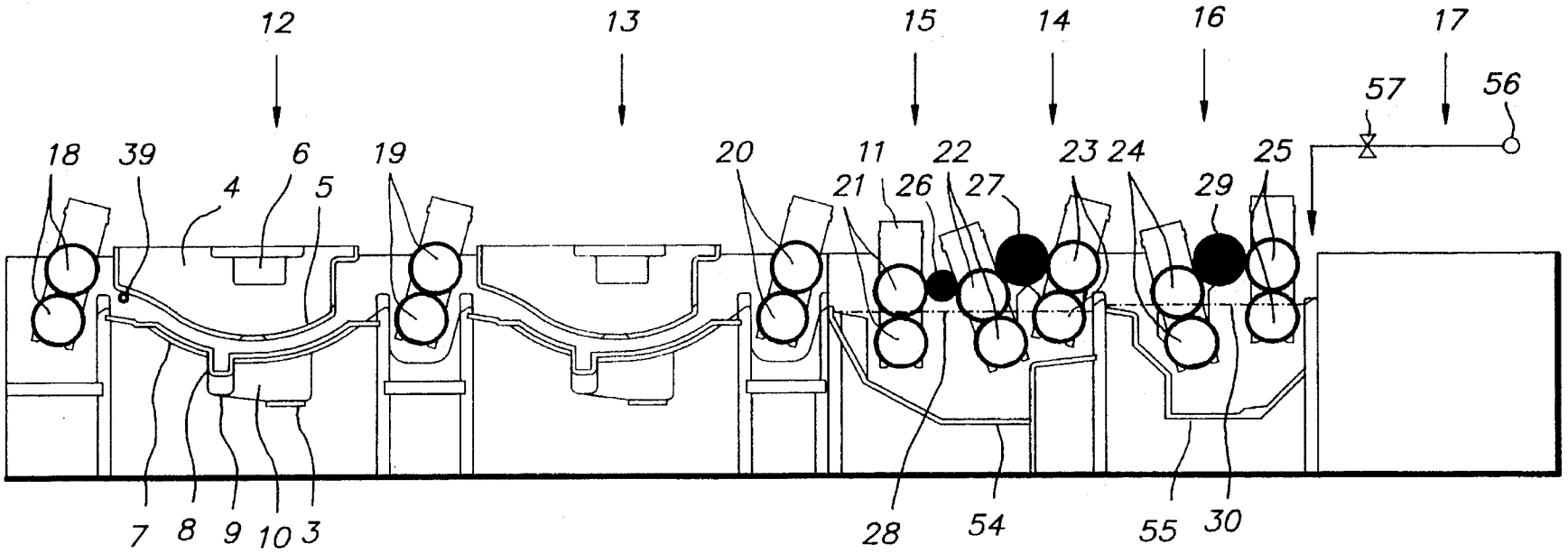
FIG. 1 is a diagrammatic longitudinal section of one embodiment of a processor for colour proof material.

Referring to FIG. 1, there is shown diagrammatically a processor for the processing of an exposed photographic film for colour proofing, which comprises a developing station 12, a bleach-fixing station 13, a rinsing station 14 with a first section 15 and a second one 16, and a drying station 17.

A sheet of film is transported at uniform velocity through the processor by means of suitably driven pressure roller pairs 18, 19, 20, 21, 22, 23, 24 and 25, the roller pairs for the dryer being not shown. Each roller pair is mounted between two lateral flanges spaced in parallel relationship, see one flange 11 shown for roller pair 21, that slide in a corresponding slot-like recess at the inside of the corresponding lateral wall of the processing station and are easily removable for cleaning and servicing.

Sensor means 39 which may be of the mechanical, optical or capacitive type, serves to measure the amount of sheet material which is being processed. The term "amount" should be interpreted in the broadest possible sense. It covers a simple sensor which measures the length only of a processed sheet (by multiplication of measured time by speed of transport) and thereby gives indications which are independent from the width of the sheet and thereby are not accurate, or in the case of known formats gives the possibility to find the width of the processed sheet (and as a consequence thereof the surface), as well as a row of sensors that extend widthwise of the processor and give an indication of the length as well as of the width of the sheets.

A particularly interesting embodiment of sensing means is disclosed in our copending applications EP 0 583 032 and EP 0 582 751, both entitled "Photographic development apparatus", filed Aug. 11, 1992.

Developing station 12 comprises a tray 7 with a central gutter 8 slightly running down in a direction transverse to that of the sheet transport, and having a deepest point 9 communicating with a holder 10 from which liquid can be withdrawn at point 3. A cover 4 has a convexly curved bottom 5 defining with the shape of tray 7 a concave path for the sheet transport. A grip 6 allows easy removal of the cover from the tray.

The developing station may be connected to a cubitainer containing appropriate developer composition which is circulated continuously at a reduced rate through the station. Since the amount of developer liquid contained in the tray-like station 12 is small as compared with that in the cubitainer, oxidation at the air is limited.

Fixing station 12 has a construction which is identic to that of the developing station and may be connected to a cubitainer containing a bleach-fixing solution. In this instance it is advantageous to carry out the replenishing of the station as a function of the amount of processed material.

Rinsing station 14 comprises a first section 15 which is operative as a washing station, and a second station 16 which operates as a rinsing station. It is clear that the processing operations in both stations are in fact identic, but the large amount of soluble material from a processed film which is collected in the first section appeals on washing rather than on rinsing.

Section 15 comprises three driven pressure roller pairs 21, 22 and 23 and intermediate cleaning rollers 26 and 27 driven by frictional contact with the upper rollers of the different roller pairs. The axis of the cleaning rollers is located higher than the axis of the corresponding pressure rollers with which they are in contact. The cleaning rollers have a circumferential covering of a resilient velvet-like material that is very effective in keeping the upper rollers of roller pairs 21 to 23 clean. The rollers of roller pairs 21 to 23 comprise a resilient covering, e.g. a layer of EPDM elastomer, (a terpolymer of ethylene propylene and diene). The level of the rinsing water in this section is indicated by broken line 28.

The construction of the second section 16 is largely similar to that of the first one, except that only two pressure roller pairs 24 and 25 are provided with one co-operating cleaning roller 29. Roller pair 24 has a TEFLON (Registered Tradename for polytetrafluoroethylene) covering, whereas roller pair 25 has a resilient covering, similar to roller pairs 21, 22 and 23. The liquid level in this section is indicated by broken line 48.

The washing of the photographic material may occur in countercurrent, replenishing liquid being added near the exit of section 16 and excess liquid being carried off near the entry of section 15. More details about an interesting embodiment of a rinsing station operating in countercurrent can be found in our copending application entitled "Photographic liquid processing station" filed on even day herewith.

Figure 2:
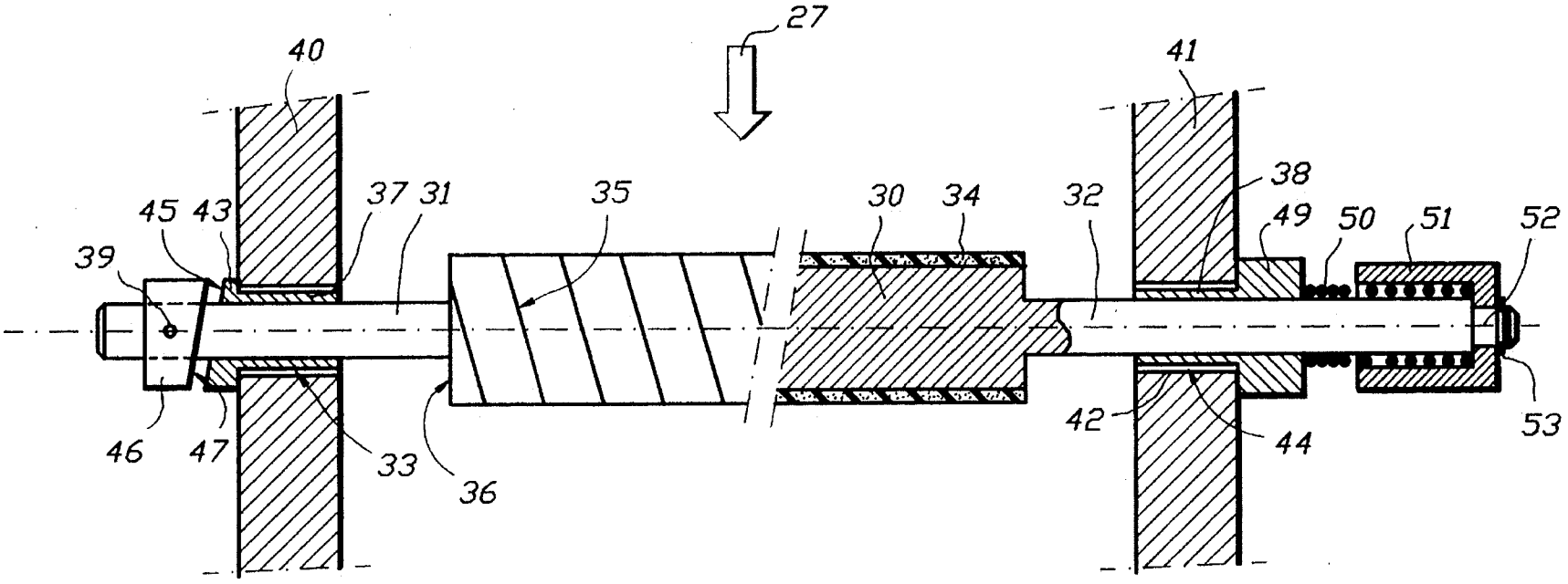
FIG. 2 is a plan view of a cleaning roller.

FIG. 2 shows a plan view of cleaning roller 27, it being understood that the three cleaning rollers are equal to each other, except for the smaller diameter of roller 26 resulting from the reduced space between the upper rollers of roller pairs 21 and 22.

Roller 27 consists of a steel body 30 with two shaft ends 31 and 32. A circumferential covering 34 of pile fabric was applied onto portion 30 of the roller. Since suitable pile fabric was available in a width of 30 mm only, a length of such fabric having a self-adhesive back layer was helically wound around the roller in windings 35. Opposite lateral edges of the length of fabric abutted tightly against each other. The ends of the fabric at the lateral ends of the roller, see e.g. end 36, were cut off with a sharp knife and the remaining edges were extra sealed with an adhesive to avoid occasional loss of piles.

Shaft ends 31 and 32 are rotatably journalled in slide bearings 37 and 38. These bearings are plastic components, preferably made by injection moulding, having a square cross-section fitting with some clearance, as shown by gap 42, in corresponding vertical slots 33 and 44 of the lateral walls 40 and 41 of section 15.

Bearing 37 has an integral cylindrical head 43 with a slanting end face 45 constituting a stationary cam for a cam follower in the form of a sleeve 46 with slanting end face 47, which is fitted to shaft 31 by a radial pin 39. Both co-operating end faces bear in normal operation onto each other but have been shown slightly separated for clearness sake.

Bearing 38 has an integral cylindrical head 49 forming a stationary support for a helical compression spring 50 seated in a cap 51 rotatably fitting on extremity 52 of shaft 32. A spring clip 53 retains the cap on the shaft. The bias of spring 50 is at the one hand sufficiently high, so that in operation of the arrangement, i.e. roller 27 rotating by frictional contact with the driven upper rollers of roller pairs 22 and 23, follower 46 is always kept in contact with cam 43 so that roller 27 performs a swinging axial movement. The bias of spring 50 is at the other hand sufficiently small to allow bearings 37 and 38 to remain freely displaceable in slots 33 and 44 under the force of gravity acting on the mass of roller 27, so that this roller always is in firm rolling contact with upper rollers 22 and 23.

In operation of rinsing station 14, it is noticed that the liquid of section 15 becomes gradually polluted by non-image parts washed-off from a processed sheet by roller pairs 21, 22 and 23. Fresh liquid may be added to section 15 from section 16 which has an overflow to section 15. Section 16 may on its turn be replenished by tap water from supply 56 under control of a valve 57 in response to a measuring signal from the level sensor of said section. Excess liquid in section 15 may flow away via a weir controlling the level of the processing liquid. In an alternative embodiment processing liquid may be carried off from section 15 in response to a signal from sensor 39, and fresh liquid be automatically added so that a desired liquid level is maintained. This latter technique forms the subject of our co-pending application "Photographic liquid processing station" referred to hereinbefore. There is constant exchange of processing liquid between the surfaces of the upper rollers of the pressure roller pairs and the cleaning rollers so that the surface condition of the pressure roller pairs is such that the washing-off of the sheets is satisfactory without any longitudinal streak- or band-like defects on the sheets. This auto-cleaning effect of the cleaning rollers is remarkable since the rate of replenishing was sharply reduced whereby the liquid in the station became extremely polluted, its visual aspect giving the impression that no satisfactory results could be expected.

The following example illustrates the described rinsing station.

| | |
|---|---|
| Operational length of the roller pairs 21, 22, 23, 24 and 25 | 800 mm |
| Diameter of these rollers | 40 mm |
| Diameter of roller 26 | 20 mm |
| Diameter of roller 27 | 35.4 mm |
| Diameter of roller 29 | 35.4 mm |
| Mass of roller 26 | 2 kg |
| Mass of roller 27 | 2.5 kg |
| Mass of roller 29 | 2.5 kg |
| Covering of rollers 26, 27 and 29 | velvet |
| backing fabric | polypropylene |
| piles | Teflon (registered trade name) |
| pile length | 4 mm |
| pile density | 80,000 per $cm^2$ |
| Operational width of the stations | 850 mm |
| Liquid content of section 15 | 7 $dm^3$ |
| Liquid content of section 16 | 6 $dm^3$ |
| Replenishing rate of section 15 (ml per $m^2$ of processed material) | 300 $ml/m^2$ |
| Replenishing rate of section 16 (ml per $m^2$ of processed material) | 300 $ml/m^2$ |

The present invention is not limited to the described embodiment.

The use of cleaning rollers is not limited to the upper rollers of the pressure roller pairs. Further, improved results have been obtained in some instances if the lower roller of pressure roller pair was replaced by a cleaning roller of the type of rollers 24, 27 or 29. Improved results means that pollution of the rinsing water could even be stronger or in other words, rates of replenishing could even be less without giving rise to defects of a kind as mentioned hereinbefore.

The use of cleaning rollers is not limited to rinsing stations but may find application in other stations that may cause streak-and band-like defects, for instance fixing, bleach fixing and stabilisation stations.

The velvet covering of the cleaning rollers may be made from other materials. Satisfactory results can also be obtained with piles of polypropylene or rayonne, or of a blend of different materials.

We claim:

1. Photographic processor for treating an image-wise exposed photographic sheet material with a processing liquid, which comprises:

a rinsing station (14) for containing a body of rinsing water, replenishing means (56, 57) for adding fresh rinsing water to said station, driven pressure roller pairs (21, 22, 23, 24, 25) for conveying said sheet material through said body of rinsing water, and at least one cleaning roller (26, 27, 29) with a circumferential covering of a pile fabric (34), which is in frictional contact with at least one roller of a roller pair of said pressure roller pairs, and the peripheral speed of which is equal to that of said at least one roller.

2. Photographic processor according to claim 1, wherein the lower rollers of the pressure roller pairs completely dip in the processing liquid and the upper rollers at least partially dip therein.

3. Photographic process according to claim 1, wherein the cleaning rollers (26, 27, 29) are driven by frictional contact with the corresponding rollers of pressure roller pairs (21, 22, 23, 24, 25).

4. Photographic processor according to claim 1, wherein said cleaning rollers (26, 27, 28) are located between successive roller pairs so that one cleaning roller is in frictional contact with two rollers of adjacent pressure roller pairs.

5. Photographic processor according to claim 1, wherein a cleaning roller is in contact with the upper roller of a pressure roller pair and the axis of such cleaning roller is located higher than the axis of such upper roller(s) with which it is in frictional contact.

6. Photographic processor according to claim 1, wherein the frictional contact results from the biasing of the cleaning roller under the force of gravity.

7. Photographic processor according to claim 1, wherein the cleaning rollers (26, 27, 28) are arranged for performing an axial displacement during their rotation.

8. Photographic processor according to claim 7, wherein the driving force for such axial displacement results from the rotation of said rollers.

9. Photographic processor according to claim 8, wherein the shaft (31) of said cleaning rollers is provided with a follower (46) co-operating with a stationary cam (43).

10. Photographic processor according to claim 9, wherein said follower and said stationary cam are formed by co-axial sleeves having co-operating slanting end surfaces (45, 47).

11. Photographic processor according to claim 9, wherein said cam and follower are kept in engagement with each other by spring means (50) which axially biases said cleaning rollers.

12. Photographic processor according to claim 1, wherein said pile fabric (34) is helically wound (35) as a strip around said cleaning rollers.

13. Photographic processor according to claim 1, wherein said pile fabric is velvet.

14. Photographic processor according to claim 1, wherein said piles are made from polytetrafluoroethylene.

15. Photographic processor according to claim 1, wherein at least one lower roller of a pressure roller pair has the form of a cleaning roller with a circumferential covering of a pile fabric.

16. A photographic processor according to claim 1, wherein the rinsing water flows in counterflow to the direction of the sheet transport.

* * * * *

UNITED STATES PATENT AND TRADEMARK OFFICE

CERTIFICATE OF CORRECTION

PATENT NO. : 5,479,232

DATED : December 26, 1995

INVENTOR(S) : Van den Bergen et al.

It is certified that error appears in the above-indentified patent and that said Letters Patent is hereby corrected as shown below:

Column 1, line 40, after "the accelerated and decelerated" insert --resilient roller--.

Signed and Sealed this

Twenty-fifth Day of June, 1996

Bruce Lehman

*Attest:*

BRUCE LEHMAN

*Attesting Officer*

*Commissioner of Patents and Trademarks*